US009863024B2

(12) United States Patent
Na et al.

(10) Patent No.: US 9,863,024 B2
(45) Date of Patent: Jan. 9, 2018

(54) BULK NICKEL-BASED CHROMIUM AND PHOSPHORUS BEARING METALLIC GLASSES WITH HIGH TOUGHNESS

(71) Applicant: Glassimetal Technology, Inc., Pasadena, CA (US)

(72) Inventors: Jong Hyun Na, Pasadena, CA (US); Michael Floyd, Pasadena, CA (US); Marios D. Demetriou, West Hollywood, CA (US); William L. Johnson, San Marino, CA (US); Glenn Garrett, Pasadena, CA (US); Maximilien Launey, Pasadena, CA (US)

(73) Assignees: Glassimetal Technology, Inc., Pasadena, CA (US); Apple Inc., Cupertino, CA (US)

( * ) Notice: Subject to any disclaimer, the term of this patent is extended or adjusted under 35 U.S.C. 154(b) by 505 days.

(21) Appl. No.: 14/067,521

(22) Filed: Oct. 30, 2013

(65) Prior Publication Data

US 2014/0116579 A1 May 1, 2014
US 2014/0345755 A9 Nov. 27, 2014

Related U.S. Application Data

(60) Provisional application No. 61/720,015, filed on Oct. 30, 2012.

(51) Int. Cl.

*C22C 45/04* (2006.01)
*C22C 1/00* (2006.01)
*C22C 19/05* (2006.01)

(52) U.S. Cl.

CPC ..... *C22C 45/04* (2013.01); *C22C 1/002* (2013.01); *C22C 19/05* (2013.01); *C22C 19/058* (2013.01)

(58) Field of Classification Search
None
See application file for complete search history.

(56) References Cited

U.S. PATENT DOCUMENTS 3,856,513 A 12/1974 Chen et al.
4,116,682 A 9/1978 Polk et al.
(Continued)

FOREIGN PATENT DOCUMENTS

CN 1354274 6/2002
CN 1653200 8/2005
(Continued)

OTHER PUBLICATIONS

Park T.G. et al., "Development of new Ni-based amorphous alloys containing no metalloid that have large undercooled liquid regions," *Scripta Materialia*, vol. 43, No. 2, 2000, pp. 109-114.
(Continued)

*Primary Examiner* — George Wyszomierski
(74) *Attorney, Agent, or Firm* — Polsinelli PC

(57) ABSTRACT

A Ni-based bulk metallic glass forming alloy is provided. The alloy includes $Ni_{(100-a-b-c-d)}Cr_aNb_bP_cB_d$, where an atomic percent of chromium (Cr) a ranges from 3 to 13, an atomic percent of niobium (Nb) b is determined by x−y*a, where x ranges from 3.8 to 4.2 and y ranges from 0.11 to 0.14, an atomic percent of phosphorus (P) c ranges from 16.25 to 17, an atomic percent of boron (B) d ranges from 2.75 to 3.5, and the balance is nickel (Ni), and where the alloy is capable of forming a metallic glass object having a lateral dimension of at least 6 mm, where the metallic glass has a stress intensity factor at crack initiation when measured on a 3 mm diameter rod containing a notch with length between 1 and 2 mm and root radius between 0.1 and 0.15 mm, the stress intensity factor being at least 70 MPa $m^{1/2}$.

14 Claims, 13 Drawing Sheets

(56) References Cited

U.S. PATENT DOCUMENTS

| | | | | |
|---|---|---|---|---|
| 4,126,284 | A | 11/1978 | Ichikawa et al. | |
| 4,144,058 | A | 3/1979 | Chen et al. | |
| 4,152,144 | A | 5/1979 | Hasegawa et al. | |
| 4,385,932 | A | 5/1983 | Inomata et al. | |
| 4,385,944 | A | 5/1983 | Hasegawa | |
| 4,582,536 | A * | 4/1986 | Raybould | B22F 9/008 419/23 |
| 4,892,628 | A | 1/1990 | Guilinger | |
| 4,900,638 | A * | 2/1990 | Emmerich | B23K 35/3033 148/403 |
| 4,968,363 | A | 11/1990 | Hashimoto et al. | |
| 5,338,376 | A | 8/1994 | Liu et al. | |
| 5,429,725 | A | 7/1995 | Thorpe et al. | |
| 5,634,989 | A | 6/1997 | Hashimoto et al. | |
| 6,004,661 | A | 12/1999 | Sakai et al. | |
| 6,303,015 | B1 | 10/2001 | Thorpe et al. | |
| 6,325,868 | B1 | 12/2001 | Kim et al. | |
| 6,695,936 | B2 | 2/2004 | Johnson | |
| 8,052,923 | B2 | 11/2011 | Langlet | |
| 8,287,664 | B2 | 10/2012 | Brunner | |
| 9,085,814 | B2 * | 7/2015 | Na | |
| 2005/0263216 | A1 | 12/2005 | Chin et al. | |
| 2006/0213586 | A1 | 9/2006 | Kui | |
| 2007/0175545 | A1 | 8/2007 | Urata et al. | |
| 2009/0110955 | A1 | 4/2009 | Hartman et al. | |
| 2012/0073710 | A1 * | 3/2012 | Kim | C22C 45/02 148/548 |
| 2012/0168037 | A1 * | 7/2012 | Demetriou | C22C 45/003 148/403 |
| 2013/0048152 | A1 | 2/2013 | Na et al. | |
| 2013/0263973 | A1 | 10/2013 | Kurahashi et al. | |
| 2014/0213384 | A1 | 7/2014 | Johnson et al. | |
| 2014/0238551 | A1 | 8/2014 | Na et al. | |
| 2015/0047755 | A1 | 2/2015 | Na et al. | |
| 2015/0158126 | A1 | 6/2015 | Hartmann et al. | |
| 2015/0159242 | A1 | 6/2015 | Na et al. | |
| 2015/0176111 | A1 | 6/2015 | Na et al. | |
| 2015/0197837 | A9 | 7/2015 | Schramm et al. | |
| 2015/0240336 | A1 | 8/2015 | Na et al. | |
| 2016/0047023 | A1 | 2/2016 | Na et al. | |
| 2016/0060739 | A1 | 3/2016 | Na et al. | |
| 2016/0090644 | A1 | 3/2016 | Na et al. | |

FOREIGN PATENT DOCUMENTS

| | | |
|---|---|---|
| DE | 3929222 | 3/1991 |
| DE | 10 2011 001 784 | 10/2012 |
| DE | 102011001783 | 10/2012 |
| EP | 0014335 | 8/1980 |
| EP | 0161393 | 11/1985 |
| EP | 0260706 | 3/1988 |
| EP | 1077272 | 2/2001 |
| EP | 1108796 | 6/2001 |
| EP | 1522602 | 4/2005 |
| JP | 54-76423 | 6/1979 |
| JP | S55-148752 | 11/1980 |
| JP | S57-13146 | 1/1982 |
| JP | 63-079930 | 4/1988 |
| JP | 63079931 | 4/1988 |
| JP | 63-277734 | 11/1988 |
| JP | 1-205062 | 8/1989 |
| JP | 08-269647 | 10/1996 |
| JP | 11-71659 | 3/1999 |
| JP | 2001-049407 | 2/2001 |
| JP | 2007-075867 | 3/2007 |
| WO | WO 2012/053570 | 4/2012 |
| WO | WO 2013/028790 | 2/2013 |

OTHER PUBLICATIONS

Mitsuhashi A. et al., "The corrosion behavior of amorphous nickel base alloys in a hot concentrated phosphoric acid," *Corrosion Science*, vol. 27, No. 9, 1987, pp. 957-970.

Kawashima A. et al., "Change in corrosion behavior of amorphous Ni-P alloys by alloying with chromium, molybdenum or tungsten," *Journal of Non-Crystalline Solids*, vol. 70, No. 1, 1985, pp. 69-83.

Abrosimova G. E. et al., "Phase segregation and crystallization in the amorphous alloy $Ni_{70}Mo_{10}P_{20}$," *Physics of the Solid State*, vol. 40., No. 9, 1998, pp. 1429-1432.

Yokoyama M. et al., "Hot-press workability of Ni-based glassy alloys in supercooled liquid state and production of the glassy alloy separators for proton exchange membrane fuel cell," *Journal of the Japan Society of Powder and Powder Metallurgy*, vol. 54, No. 11, 2007, pp. 773-777.

Rabinkin et al., "Brazing Stainless Steel Using New MBF-Series of Ni—Cr—B—Si Amorphous Brazing Foils: New Brazing Alloys Withstand High-Temperature and Corrosive Environments," *Welding Research Supplement*, 1998, pp. 66-75.

Chen S.J. et al., "Transient liquid-phase bonding of T91 steel pipes using amorphous foil," *Materials Science and Engineering A*, vol. 499, No. 1-2, 2009, pp. 114-117.

Hartmann, Thomas et al., "New Amorphous Brazing Foils for Exhaust Gas Application," *Proceedings of the 4th International Brazing and Soldering Conference*, Apr. 26-29, 2009, Orlando, Florida, USA.

Habazaki et al., "Corrosion behaviour of amorphous Ni—Cr—Nb—P—B bulk alloys in 6M HCI solution," *Material Science and Engineering*, A318, 2001, pp. 77-86.

Murakami (Editor), *Stress Intensity Factors Handbook*, vol. 2, Oxford: Pergamon Press, 1987, 4 pages.

Yokoyama et al., "Viscous Flow Workability of Ni—Cr—P—B Metallic Glasses Produced by Melt-Spinning in Air," *Materials Transactions*, vol. 48, No. 12, 2007, pp. 3176-3180.

U.S. Appl. No. 14/029,719, filed Sep. 17, 2013, Na et al.

U.S. Appl. No. 14/048,894, filed Oct. 8, 2013, Na et al.

U.S. Appl. No. 14/077,830, filed Nov. 12, 2013, Na et al.

U.S. Appl. No. 14/081,622, filed Nov. 15, 2013, Na et al.

U.S. Appl. No. 14/149,035, filed Jan. 7, 2014, Na et al.

Habazaki et al., "Preparation of corrosion-resistant amorphous Ni—Cr—P—B bulk alloys containing molybdenum and tantalum," *Material Science and Engineering*, A304-306, 2001, pp. 696-700.

Zhang et al., "The Corrosion Behavior of Amorphous Ni—Cr—P Alloys in Concentrated Hydrofluoric Acid," *Corrosion Science*, vol. 33, No. 10, pp. 1519-1528, 1992.

Katagiri et al., "An attempt at preparation of corrosion-resistant bulk amorphous Ni—Cr—Ta—Mo—P—B alloys," *Corrosion Science*, vol. 43, No. 1, pp. 183-191, 2001.

* cited by examiner

BULK NICKEL-BASED CHROMIUM AND PHOSPHORUS BEARING METALLIC GLASSES WITH HIGH TOUGHNESS

CROSS-REFERENCE TO RELATED APPLICATIONS

The present application claims priority to U.S. Provisional Patent Application No. 61/720,015, entitled "Bulk Nickel-Based Chromium and Phosphorus Metallic Glasses with High Toughness", filed on Oct. 30, 2012, which is incorporated herein by reference in its entirety.

TECHNICAL FIELD

The present disclosure is directed to Ni—Cr—Nb—P—B glasses capable of forming bulk metallic glass rods with diameters greater than 3 mm and as large as 11 mm or greater.

BACKGROUND

Ni—Cr—Nb—P—B alloys capable of forming bulk metallic glass rods with diameters of 3 mm or greater have been disclosed in U.S. patent application Ser. No. 13/592,095, entitled "Bulk Nickel-Based Chromium and Phosphorus Bearing Metallic Glasses", filed on Aug. 22, 2012, the disclosure of which is incorporated herein by reference in its entirety. In that application, a peak in glass forming ability is identified at chromium (Cr) content ranging from 8.5 to 9 atomic percent, niobium (Nb) content of about 3 atomic percent, boron (B) content ranging from 3 to 3.5 atomic percent, and phosphorus (P) content of about 16.5 atomic percent. Bulk metallic glass rods with diameters as large as 11 mm can be formed. However, the alloy forms a metallic glass which has a relatively low toughness at the peak of glass formability of the alloy.

Due to the attractive engineering properties of Ni-based P and B bearing bulk glasses, such as high strength, toughness, bending ductility, and corrosion resistance, there remains a need to develop alloys with various combinations of transition metals in order to explore the possibility of even better engineering performance, specifically higher toughness, while maintaining a high glass-forming ability.

BRIEF DESCRIPTION OF THE DRAWINGS

The description will be more fully understood with reference to the following figures and data graphs, which are presented as various embodiments of the disclosure and should not be construed as a complete recitation of the scope of the disclosure, wherein.

BRIEF SUMMARY

Figure 1:
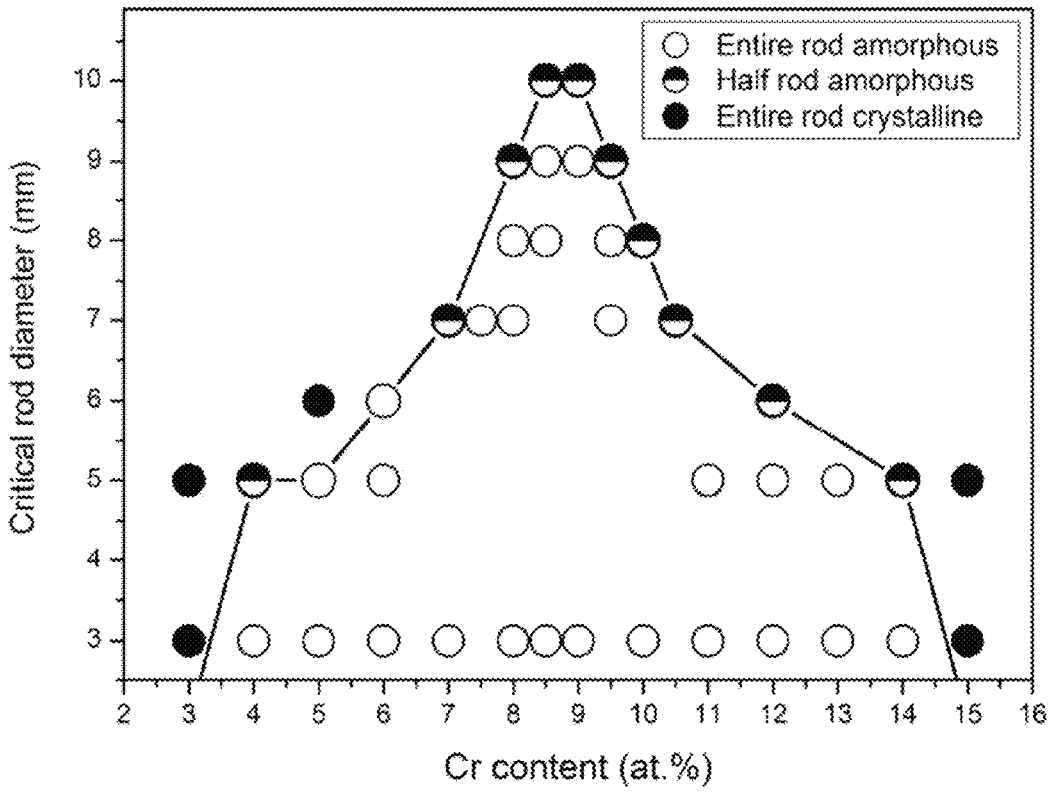
FIG. 1 provides a data plot showing the effect of Cr atomic percent on the glass forming ability of the $Ni_{77.5-x}Cr_xNb_3P_{16.5}B_3$ alloys for $3 \le x \le 15$ (this figure is FIG. 3 in previously disclosed in patent application Ser. No. 13/592,095).

The present disclosure provides Ni—Cr—Nb—P—B alloys and metallic glasses having compositional ranges along a ridge of glass-forming ability (GFA) capable of forming metallic glass rods at least 6 mm in diameter. Along this compositional ridge, the concentrations of Ni, Cr, and Nb, are simultaneously varied while maintaining the metalloid composition constant, yielding surprising combinations of mechanical performance and glass-forming ability. In embodiments, the present Ni—Cr—Nb—P—B alloys have similar glass-forming ability to previously disclosed Ni—Cr—Nb—P—B alloys, but form metallic glasses with much higher toughness than the metallic glasses formed by those previously disclosed alloys. The peak in glass forming ability in the present alloys is associated with a high metallic glass notch toughness, as opposed to a relatively low notch toughness associated with the peak in glass forming ability of the previously disclosed alloys.

In one embodiment, the disclosure provides an alloy or a metallic glass formed from the alloy, represented by the following formula (subscripts denote atomic percent):

$$Ni_{(100-a-b-c-d)}Cr_aNb_bP_cB_d \qquad \text{Equation (1)}$$

where:

a ranges from 3 to 13 b is determined by x−y*a, where x ranges from 3.8 to 4.2 and y ranges from 0.11 to 0.14 c ranges from 16.25 to 17 d ranges from 2.75 to 3.5 and wherein the metallic glass rod diameter is at least 6 mm.

In some embodiments, a ranges from 3.5 to 12.5, b is determined by x−y·a, where x ranges from 3.8 to 4.2 and y ranges from 0.11 to 0.14, c ranges from 16.25 to 17, and d ranges from 2.75 to 3.5.

In another embodiment, the alloy is represented by the following formula (subscripts denote atomic percent):

$$Ni_{77.4375-0.875a}Cr_aNb_{4.0625-0.125a}P_{16.5}B_3 \quad \text{Equation (2)}$$

where the atomic percent a of Cr ranges from 3 to 13.

In some embodiments, the atomic percent a of Cr ranges from 4 to 13.

In yet another embodiment, the atomic percent of Cr ranges from 4 to 9, and wherein the metallic glass rod diameter is at least 9 mm.

In yet another embodiment, up to 1 atomic percent of P is substituted by Si.

In yet another embodiment, up to 2 atomic percent of Cr is substituted by Fe, Co, Mn, W, Mo, Ru, Re, Cu, Pd, Pt, or combinations thereof.

In yet another embodiment, up to 2 atomic percent of Ni is substituted by Fe, Co, Mn, W, Mo, Ru, Re, Cu, Pd, Pt, or combinations thereof.

In yet another embodiment, up to 1.5 atomic percent of Nb is substituted by Ta, V, or combinations thereof.

In yet another embodiment, the alloys of the present disclosure are capable of forming metallic glass rods of diameter of at least 11 mm when rapidly quenched from the molten state.

In yet another embodiment, the melt of the alloy is fluxed with a reducing agent prior to rapid quenching.

In yet another embodiment, the temperature of the melt prior to quenching is at least 100 degrees above the liquidus temperature of the alloy.

In yet another embodiment, the temperature of the melt prior to quenching is at least 1100° C.

In yet another embodiment, the notch toughness, defined as the stress intensity factor at crack initiation when measured on a 3 mm diameter rod containing a notch with length ranging from 1 to 2 mm and root radius ranging from 0.1 to 0.15 mm, is at least 70 MPa $m^{1/2}$.

The disclosure is also directed to an alloy or a metallic glass having compositions selected from a group consisting of $Ni_{73.375}Cr_{3.5}Nb_{3.625}P_{16.5}B_3$, $Ni_{72.5}Cr_{4.5}Nb_{3.5}P_{16.5}B_3$, $Ni_{71.5}Cr_{5.64}Nb_{3.36}P_{16.5}B_3$, $Ni_{71.4}Cr_{5.64}Nb_{3.46}P_{16.5}B_3$, $Ni_{71.4}Cr_{5.52}Nb_{3.38}P_{16.67}B_{3.03}$, $N_{71.4}Cr_{5.52}Nb_{3.38}P_{16.17}B_{3.03}Si_{0.5}$, $Ni_{70.5}Cr_{6.78}Nb_{3.22}P_{16.5}B_3$, $Ni_{68.5}Cr_9Nb_3P_{16.5}B_3$, $Ni_{67.25}Cr_{10.5}Nb_{2.75}P_{16.5}B_3$ and $Ni_{65.5}Cr_{12.5}Nb_{2.5}P_{16.5}B_3$.

In a particular embodiment, the alloy includes the composition $Ni_{67.25}Cr_{5.5}Nb_{3.4}P_{16.5}B_3$, and is capable of forming an amorphous bulk object having a lateral dimension of at least 11 mm.

In a further embodiment, a method is provided for forming a metallic glass. The method includes melting an alloy into a molten state, the alloy comprising at least Ni, Cr, Nb, P, and B with a formula $Ni_{(100-a-b-c-d)}Cr_aNb_bP_cB_d$, wherein an atomic percent of chromium (Cr) a ranges from 3.5 to 12.5, an atomic percent of niobium (Nb) b is determined by x−y*a, where x ranges from 3.8 to 4.2 and y ranges from 0.11 to 0.14, an atomic percent of phosphorus (P) c ranges from 16.25 to 17, an atomic percent of boron (B) d ranges from 2.75 to 3.5, and the balance is nickel (Ni). The method also includes quenching the molten alloy at a cooling rate sufficiently rapid to prevent crystallization of the alloy.

Additional embodiments and features are set forth in part in the description that follows, and in part will become apparent to those skilled in the art upon examination of the specification or may be learned by the practice of the invention. A further understanding of the nature and advantages of the present invention may be realized by reference to the remaining portions of the specification and the drawings, which forms a part of this disclosure.

DETAILED DESCRIPTION

The present disclosure may be understood by reference to the following detailed description, taken in conjunction with the drawings as described below. It is noted that, for purposes of illustrative clarity, certain elements in various drawings may not be drawn to scale.

Description of Alloy Compositions and Metallic Glass Compositions

In accordance with the provided disclosure and drawings, Ni—Cr—Nb—P—B alloys are provided that lie along a well-defined compositional ridge that requires very low cooling rates to form metallic glass, thereby allowing for bulk metallic glass formation such that metallic glass rods with diameters greater than at least 6 mm can be formed. In particular embodiments, by controlling the relative concentrations of Ni, Cr, and Nb, and by incorporating minority additions of about 16.5 atomic percent of P and about 3 atomic percent of B, these alloys can form metallic glass rods with diameters greater than 6 mm. The present compositional ridge provides alloys that have a combination of both good glass formability and relatively high toughness for the metallic glasses formed from the alloys In the present disclosure, the glass-forming ability of each alloy is quantified by the "critical rod diameter", defined as maximum rod diameter in which the amorphous phase can be formed when processed by a method of water quenching a quartz tube containing a molten alloy.

The notch toughness, defined as the stress intensity factor at crack initiation $K_q$, is the measure of the material's ability to resist fracture in the presence of a notch. The notch toughness is a measure of the work required to propagate a crack originating from a notch. A high $K_q$ ensures that the material will be tough in the presence of defects.

In some embodiments, Ni—Cr—Nb—P—B alloys that fall along the compositional ridge of the disclosure that have a critical rod diameter of at least 6 mm can be represented by the following formula (subscripts denote atomic percent):

$$Ni_{(100-a-b-c-d)}Cr_aNb_bP_cB_d \quad \text{Equation (1)}$$

where a ranges from 3 to 13, b is determined by x−y·a, where x ranges from 3.8 to 4.2 and y ranges from 0.11 to 0.14, c ranges from 16.25 to 17, and d ranges from 2.75 to 3.5.

In some embodiments, Ni—Cr—Nb—P—B alloys that fall along the compositional ridge of the disclosure that have a critical rod diameter of at least 6 mm can be represented by Equation (1), where a ranges from 3.5 to 12.5, b is determined by x−y·a, where x ranges from 3.8 to 4.2 and y ranges from 0.11 to 0.14, c ranges from 16.25 to 17, and d ranges from 2.75 to 3.5.

In some embodiments, Ni—Cr—Nb—P—B alloys that fall along the compositional ridge of the disclosure can be represented by the following Equation (subscripts denote atomic percent):

$$Ni_{77.4375-0.875a}Cr_aNb_{4.0625-0.125a}P_{16.5}B_3 \quad \text{Equation (2)}$$

where the atomic percent a of Cr ranges from 3 to 13.

In some embodiments, Ni—Cr—Nb—P—B alloys that fall along the compositional ridge of the disclosure can be represented by Equation (2), where the atomic percent a of Cr ranges from 4 to 13.

Embodiments of the present Ni—Cr—Nb—P—B metallic glasses in accordance with the above equations have critical rod diameters as large as 11 mm or larger, and have significantly higher notch toughness than the Ni—Cr—Nb—P—B metallic glasses disclosed in the previous U.S. patent application Ser. No. 13/592,095.

Specific embodiments of metallic glasses formed from alloys with compositions that satisfy the disclosed composition formula, Equation (1), are presented in Table 1. Samples 1-3 and 7-10 satisfy the narrower range given by Equation (2), which lies approximately midway across the range given by Equation (1).

The critical rod diameters of sample alloys, along with the notch toughness of corresponding metallic glasses, are also listed in Table 1. All Samples 1-10 have an atomic percent Cr that ranges from 3.5 to 12.5, and critical rod diameters of 6 mm or larger. Furthermore, Samples 2-8, which have an atomic percent Cr ranging from 4 to 9, and have critical rod diameters ranging from 9 mm to 11 mm. In particular, Sample 5 with a Cr content of about 5.5 atomic percent, a Nb content of about 3.4 atomic percent, a B content of about 3 atomic percent, and a P content of about 16.5 atomic percent demonstrates a peak in glass forming ability, exhibiting a critical rod diameter of 11 mm. Sample 8 with 8.5 atomic percent of Cr, 3 atomic percent of Nb, 16.5 atomic percent of P, and 3 atomic percent of B, is the alloy closest to the peak in glass forming ability as disclosed in the previous U.S. patent application Ser. No. 13/592,095, exhibiting a critical rod diameter of 10 mm.

The metallic glasses Samples 1-7 and 9 exhibit a notch toughness of at least 70 MPa $m^{1/2}$ or higher, which is about twice as high as the 34 MPa $m^{1/2}$ value demonstrated by the metallic glass Sample 8, which has the lowest notch toughness among all the samples. The metallic glass Sample 10 has lower notch toughness than Samples 1-7 and 9.

A minor compositional adjustment was performed on Sample 3 as follows: the niobium concentration is increased by 0.1 atomic percent at the expense of nickel. The result is Sample 4, which showed no change in glass forming ability but a slight improvement in toughness exhibiting notch toughness of about 75 MPa $m^{1/2}$.

A small compositional fine-tuning was also performed on Sample 4 as follows: the total metalloid content (i.e. the sum of the phosphorus and boron concentrations) is inflated by 0.2 atomic percent, the total transition metal content (i.e. the sum of the chromium and niobium concentrations) is deflated by 0.2 atomic percent, while the nickel concentration is kept unchanged. The result is Sample 5, which showed a slight improvement in glass forming ability exhibiting a critical rod diameter of 11 mm, but a slight drop in toughness, exhibiting notch toughness of about 75 MPa $m^{1/2}$.

A further refinement is performed on Sample 5 by substituting 0.5 atomic percent P by Si. The result is Sample 6. Sample 6 demonstrates a critical rod diameter of 10 mm and a notch toughness of about 82 MPa $m^{1/2}$.

TABLE 1

Sample Ni—Cr—Nb—P—B (optionally containing Si) compositions and associated glass forming ability of the alloys and notch toughness of the metallic glasses.

| Sample | Composition | Critical Rod Diameter [mm] | Notch Toughness (MPa $m^{1/2}$) |
|---|---|---|---|
| 1 | $Ni_{73.375}Cr_{3.5}Nb_{3.625}P_{16.5}B_3$ | 6 | 82.4 ± 1.4 |
| 2 | $Ni_{72.5}Cr_{4.5}Nb_{3.5}P_{16.5}B_3$ | 9 | 85.0 ± 2.1 |
| 3 | $Ni_{71.5}Cr_{5.64}Nb_{3.36}P_{16.5}B_3$ | 10 | 80.4 ± 5.3 |
| 4 | $Ni_{71.4}Cr_{5.64}Nb_{3.46}P_{16.5}B_3$ | 10 | 85.5 ± 2.9 |

TABLE 1-continued

Sample Ni—Cr—Nb—P—B (optionally containing Si) compositions and associated glass forming ability of the alloys and notch toughness of the metallic glasses.

| Sample | Composition | Critical Rod Diameter [mm] | Notch Toughness (MPa $m^{1/2}$) |
|---|---|---|---|
| 5 | $Ni_{71.4}Cr_{5.52}Nb_{3.38}P_{16.67}B_{3.03}$ | 11 | 74.6 ± 0.8 |
| 6 | $Ni_{71.4}Cr_{5.52}Nb_{3.38}P_{16.17}B_{3.03}Si_{0.5}$ | 10 | 82.1 ± 2.8 |
| 7 | $Ni_{70.5}Cr_{6.78}Nb_{3.22}P_{16.5}B_3$ | 9 | 75.2 ± 0.6 |
| 8 | $Ni_{69}Cr_{8.5}Nb_3P_{16.5}B_3$ | 10 | 33.5 ± 5.2 |
| 9 | $Ni_{67.25}Cr_{10.5}Nb_{2.75}P_{16.5}B_3$ | 8 | 71.4 ± 9.0 |
| 10 | $Ni_{65.5}Cr_{12.5}Nb_{2.5}P_{16.5}B_3$ | 6 | 54.0 ± 3.1 |

FIG. 1 provides a data plot showing the effect of Cr atomic percent x on the glass forming ability of the $Ni_{77.5-x}Cr_xNb_3P_{16.5}B_3$ alloys, where $3 \le x \le 15$ (previously disclosed in patent application Ser. No. 13/592,095). As shown, the alloy has a peak in GFA between 8.5 and 9 atomic percent Cr.

Figure 2:
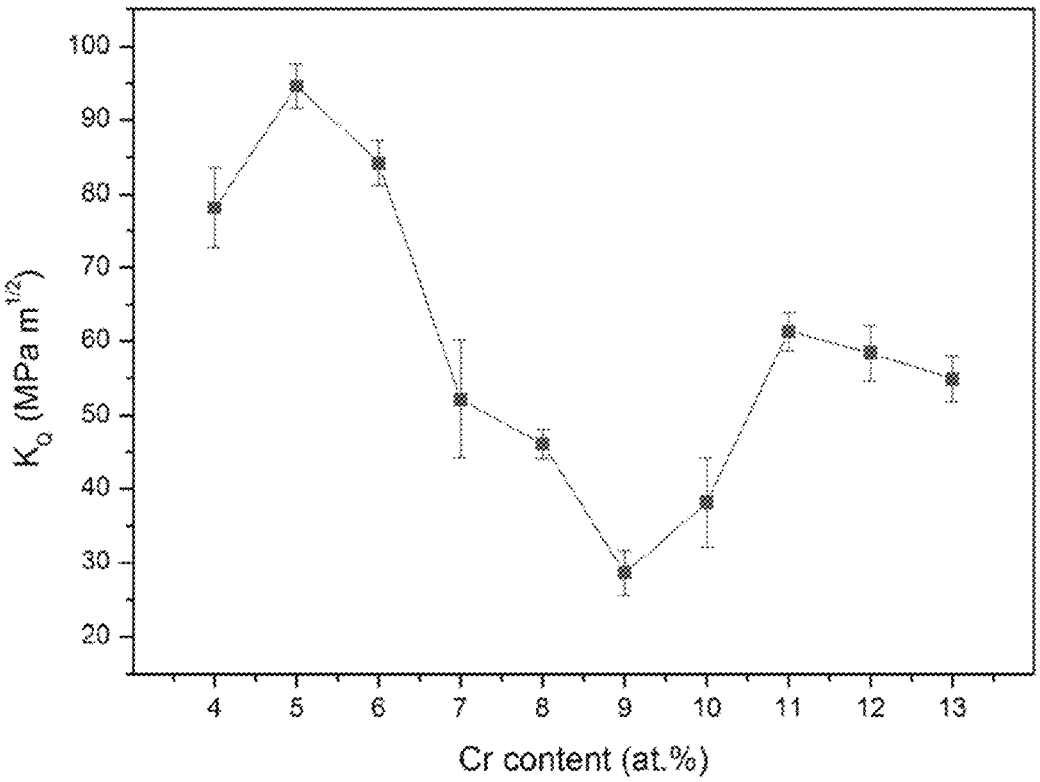
FIG. 2 provides a data plot showing the effect of Cr atomic percent on the notch toughness of the metallic glasses $Ni_{77.5-x}Cr_xNb_3P_{16.5}B_3$ for $4 \le x \le 13$ (this figure is FIG. 19 in previously disclosed in patent application Ser. No. 13/592,095).

FIG. 2 provides a data plot showing the effect of Cr atomic percent x on the notch toughness of the metallic glasses $Ni_{77.5-x}Cr_xNb_3P_{16.5}B_3$, where $4 \le x \le 13$ (previously disclosed in patent application Ser. No. 13/592,095). As shown, the alloy at the peak of GFA with 9 atomic percent Cr, as shown in FIG. 1, has a low notch toughness of about 30 MPa $m^{1/2}$.

Figure 3:
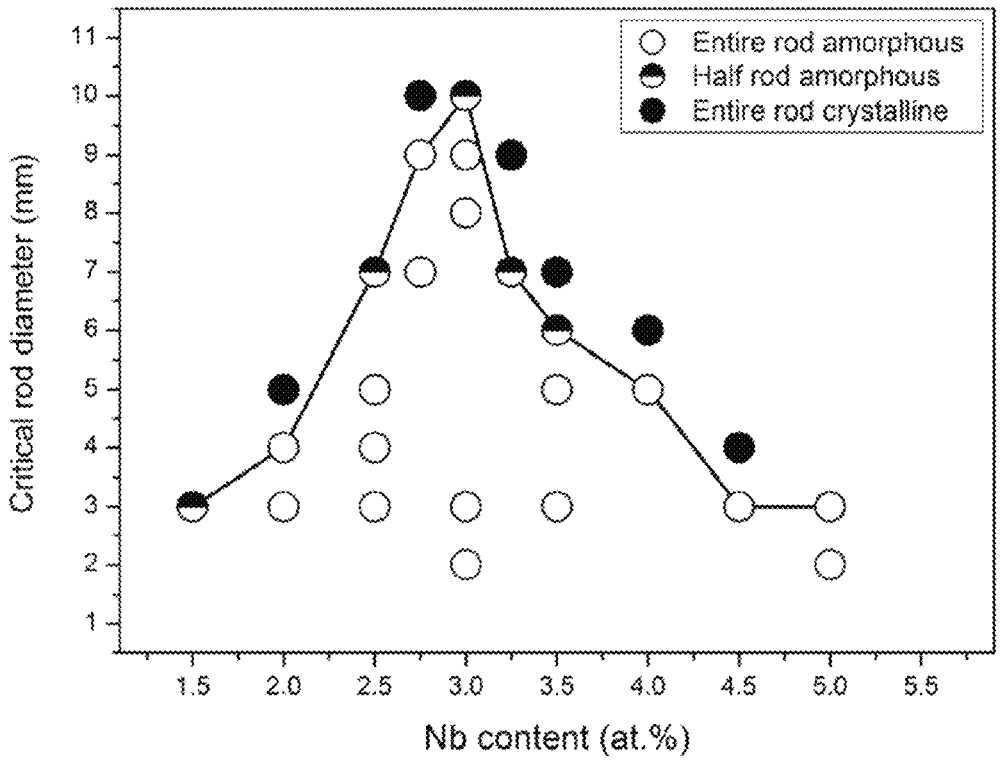
FIG. 3 provides a data plot showing the effect of Nb atomic percent on the glass forming ability of the $Ni_{69}Cr_{11.5-x}Nb_xP_{16.5}B_3$ alloys for $1.5 \le x \le 5$ (this figure is FIG. 2 in previously disclosed in patent application Ser. No. 13/592,095).

FIG. 3 provides a data plot showing the effect of Nb atomic percent x on the glass forming ability of the $Ni_{69}Cr_{11.5-x}Nb_xP_{16.5}B_3$ alloys, where $1.5 \le x \le 5$ (previously disclosed in patent application Ser. No. 13/592,095). As shown, the alloys have a peak in GFA at 3 atomic percent Nb.

Figure 4:
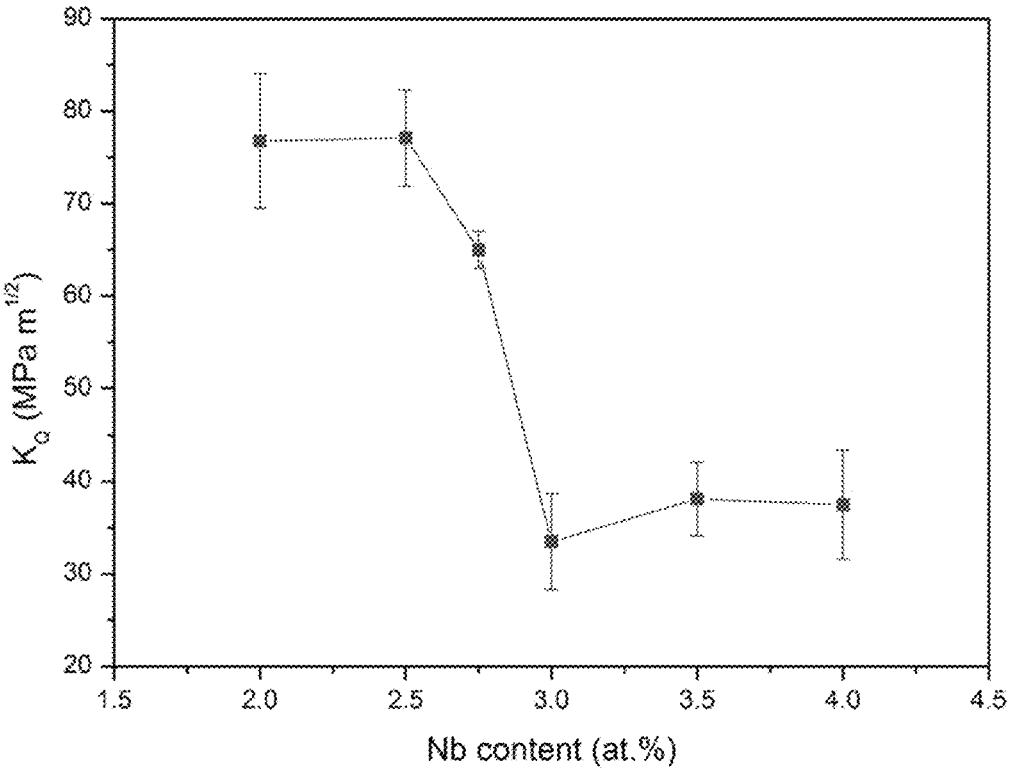
FIG. 4 provides a data plot showing the effect of Nb atomic percent on the notch toughness of the metallic glasses $Ni_{69}Cr_{11.5-x}Nb_xP_{16.5}B_3$ for $2 \le x \le 4$ (this figure is FIG. 29 in previously disclosed in patent application Ser. No. 13/592,095).

FIG. 4 provides a data plot showing the effect of Nb atomic percent x on the notch toughness of the metallic glasses having the composition $Ni_{69}Cr_{11.5-x}Nb_xP_{16.5}B_3$, where $2 \le x \le 4$ (previously disclosed in patent application Ser. No. 13/592,095). As shown, the alloy at the peak of GFA with 3 atomic percent Nb, as shown in FIG. 1, has a low notch toughness of about 35 MPa $m^{1/2}$.

Figure 5:
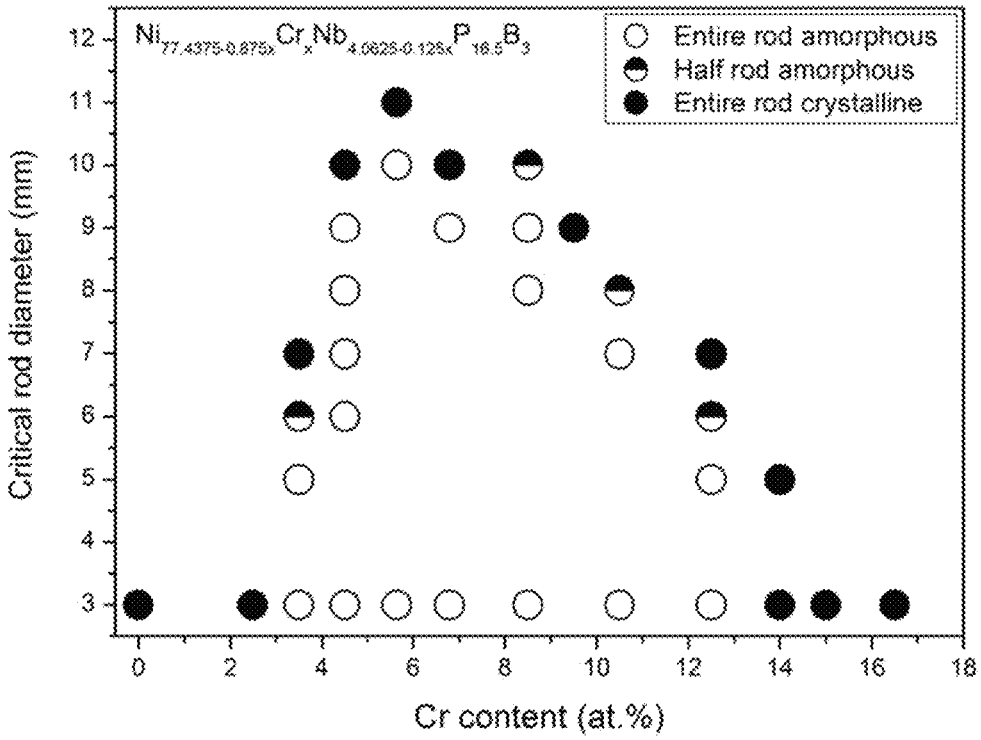
FIG. 5 provides a data plot showing the effect of Cr atomic percent on the glass forming ability of the $Ni_{77.4375-0.875x}Cr_xNb_{4.0625-0.125x}P_{16.5}B_3$ alloys in accordance with embodiments of the present disclosure.

FIG. 5 provides a data plot of the critical rod diameter of the $Ni_{77.4375-0.875x}Cr_xNb_{4.0625-0.125x}P_{16.5}B_3$ alloys against the atomic percent of Cr (Samples 1-3 and 7-10 listed in Table 1) in accordance with embodiments of the present disclosure. The sample alloy compositions satisfy Eq. 2. As seen in FIG. 5, when the Cr content is between 3 and 13 atomic percent and the Nb content is determined by Equation (2), the critical rod diameter is greater than 6 mm and as large as 10 mm. It is also evident that the transition to high glass forming ability occurs very sharply between 3 and 3.5 atomic percent, peaks at about 5.5%, and then degrades very sharply between 12.5 and 13 atomic percent. The effect of a variable x (i.e. simultaneously varying Cr and Nb contents at the expense of Ni according to Equation (2)) on glass forming ability was not considered in the previous patent application Ser. No. 13/592,095.

Figure 6:
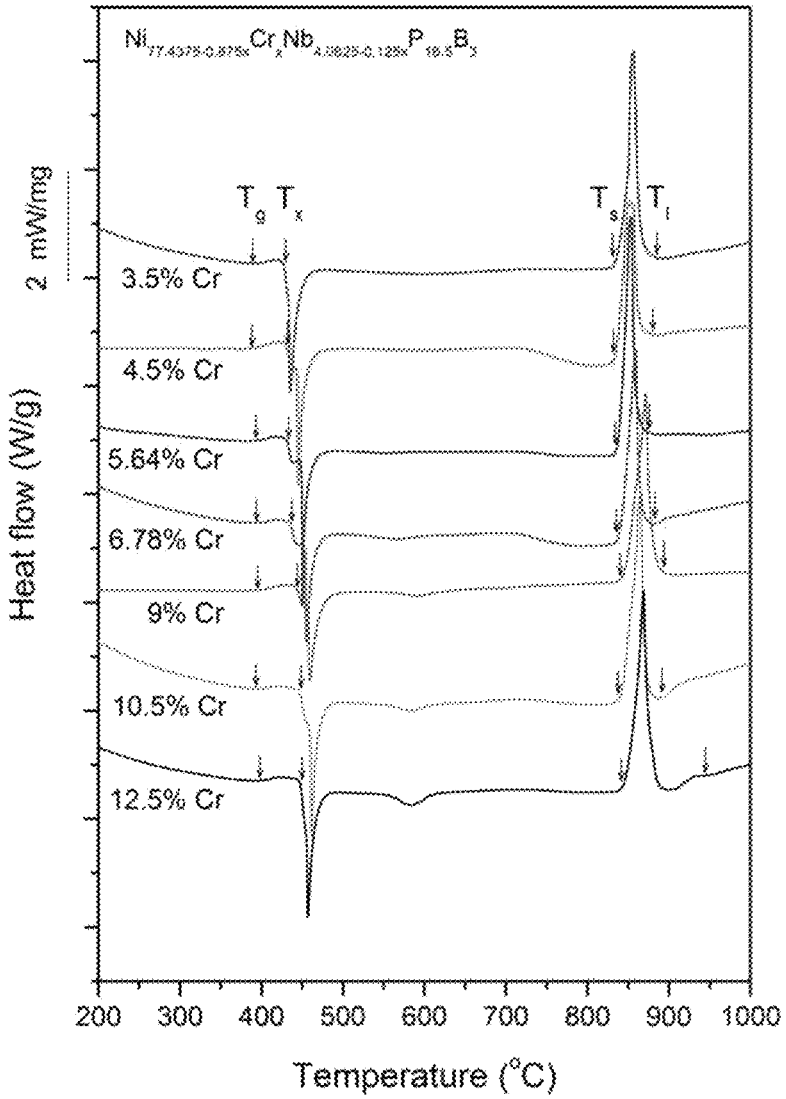
FIG. 6 illustrates calorimetry scans for sample metallic glasses of the $Ni_{77.4375-0.875x}Cr_xNb_{4.0625-0.125x}P_{16.5}B_3$ series with varying Cr atomic percent in accordance with embodiments of the present disclosure.

FIG. 6 illustrates calorimetry scans for sample metallic glasses of the $Ni_{77.4375-0.875x}Cr_xNb_{4.0625-0.125x}P_{16.5}B_3$ series with varying Cr atomic percent in accordance with embodiments of the present disclosure. In FIG. 6, arrows from left to right designate the glass-transition, crystallization, solidus and liquidus temperatures, respectively.

The differential calorimetry scans of the metallic glasses $Ni_{77.4375-0.875x}Cr_xNb_{4.0625-0.125x}P_{16.5}B_3$ reveal that the solidus and liquidus temperatures pass through a shallow minimum when the atomic percent of Cr ranges from 4.5 to 6, where the peak in glass forming ability is observed as shown in FIG. 5.

Figure 7:
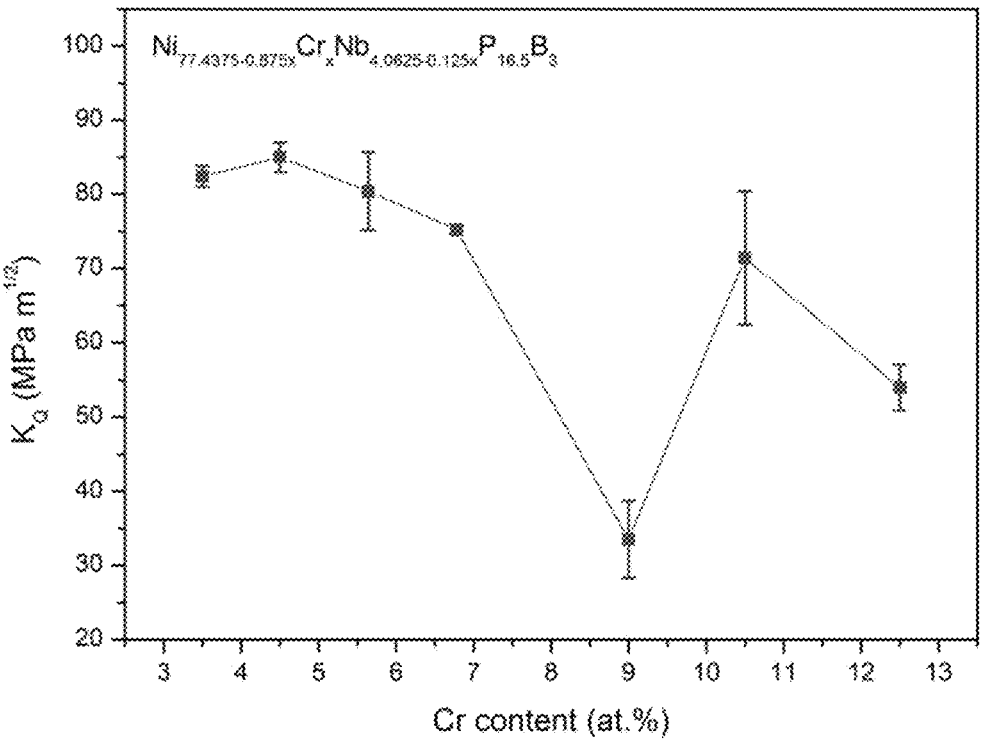
FIG. 7 provides a data plot showing the effect of Cr atomic percent on the notch toughness of the metallic glasses $Ni_{77.4375-0.875x}Cr_xNb_{4.0625-0.125x}P_{16.5}B_3$ in accordance with embodiments of the present disclosure.

FIG. 7 provides a data plot showing effect of Cr atomic percent on the notch toughness of the metallic glasses $Ni_{77.4375-0.875x}Cr_xNb_{4.0625-0.125x}P_{16.5}B_3$ in accordance with embodiments of the present disclosure. The notch toughness of embodiments of metallic glasses that satisfy Equation (2) is plotted in FIG. 7. As seen in the plot, the notch toughness reaches a peak at x=4.5 atomic percent, where the glass forming ability is also near the peak provided in the present disclosure, and passes through a deep lowest value near x=9 atomic percent, where the lowest value of 33.5 MPa $m^{1/2}$ is associated with the peak in glass forming ability in the previously disclosed alloys as presented in U.S. patent application Ser. No. 13/592,095. Therefore, the Ni—Cr—Nb—P—B alloys of the present disclosure have comparable or better glass forming ability, but the Ni—Cr—Nb—P—B metallic glasses formed from the alloys have much higher notch toughness than the Ni—Cr—Nb—P—B metallic glasses disclosed previously.

Figure 8:
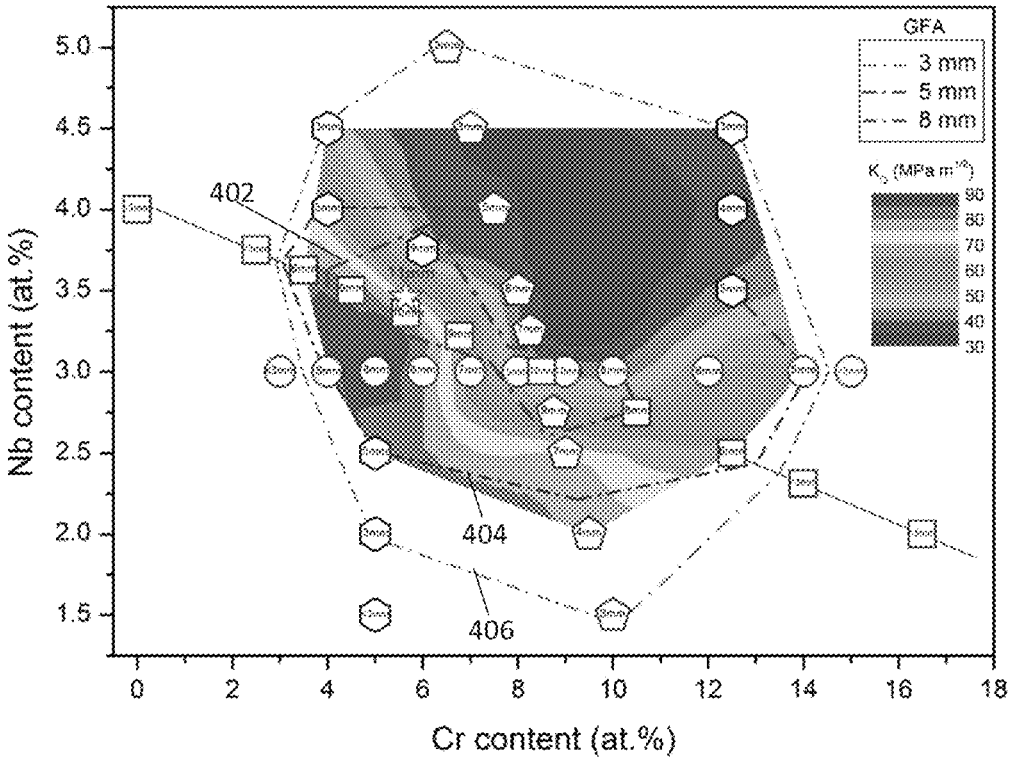
FIG. 8 provides a contour plot of the glass forming ability and notch toughness of the Ni—Cr—Nb—P—B alloys and metallic glasses plotted against the Cr and Nb contents, in accordance with embodiments of the present disclosure.

FIG. 8 provides a contour plot of glass forming ability of Ni—Cr—Nb—P—B alloys and notch toughness of the Ni—Cr—Nb—P—B metallic glasses formed from the alloys plotted against the Cr and Nb contents in accordance with embodiments of the present disclosure. The Cr content is on the horizontal axis and the Nb content is on the vertical axis. There are three contours: 402, 404, and 406, for GFA of 8 mm, 5 mm, and 3 mm, respectively. A composition ridge of Cr and Nb is defined by Equation (1) or (2). Along the ridge the glass forming ability is at least 6 mm or higher. The ridge defines the alloys that satisfy Equation (1) or (2), while alloys falling on either side of that ridge, such as beyond the ridge but within regions 404 and 406, have lower glass forming abilities. The peak in glass forming ability provided in the present disclosure is also shown to be located in the region where notch toughness is high, as opposed to the lower notch toughness for the peak in glass forming ability of the alloys disclosed in the U.S. patent application Ser. No. 13/592,095, as discussed in the background.

In the composition ridge, the atomic percent B is about 3, the atomic percent P is about 16.5, and the atomic percent of Nb and Cr are entwined to satisfy Equation (1) or Equation (2), such that the atomic percent Nb ranges from about 3 to about 3.5 and the content of Cr ranges from about 3.5 to about 9 atomic percent. Using these compositional ranges, bulk metallic glass rods with diameters ranging from 9 to 11 mm or larger can be formed. The notch toughness for the metallic glasses within the composition ridge is at least 70 MPa $m^{1/2}$.

Figure 9:
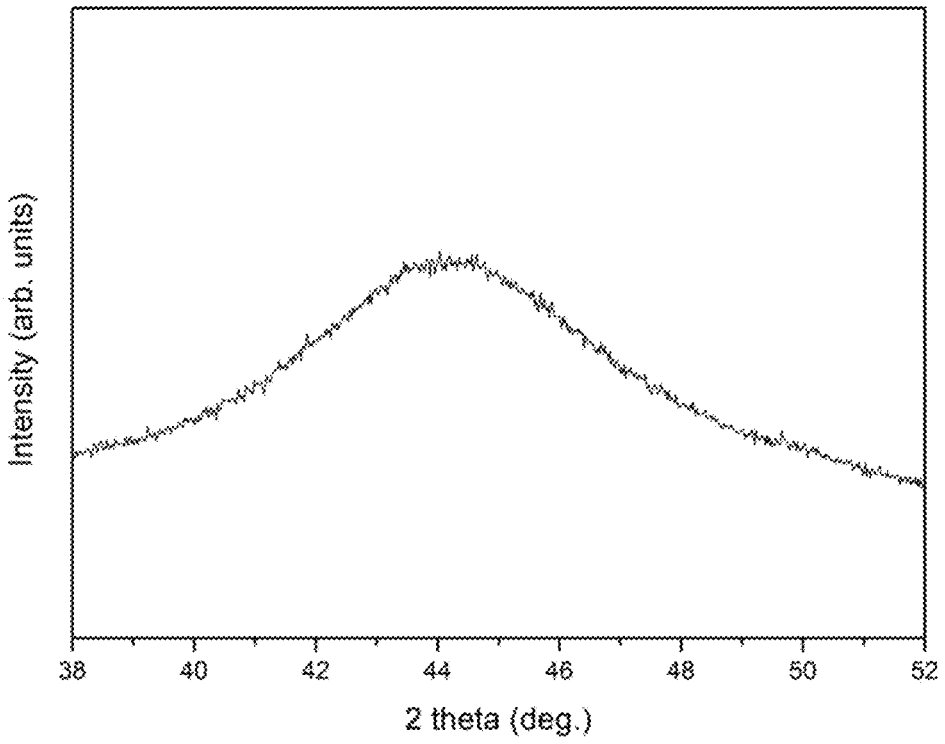
FIG. 9 provides an X-ray diffractogram verifying the amorphous structure of a 10 mm rod of sample metallic glass $Ni_{71.4}Cr_{5.52}Nb_{3.38}P_{16.67}B_{3.03}$ in accordance with embodiments of the present disclosure.

Sample alloy 5 with composition $Ni_{71.4}Cr_{5.52}Nb_{3.38}P_{16.67}B_{3.03}$ has critical rod diameter of 11 mm when processed in quartz tubes with 0.5 mm thick walls, as described herein. This alloy was also processed in a quartz tube having 1 mm thick wall (rather than 0.5 mm thick walls as in the method described herein), and was found capable of forming fully amorphous 10 mm rods. FIG. 9 illustrates an X-ray diffractogram verifying the amorphous structure of a 10 mm rod of sample metallic glass $Ni_{71.4}Cr_{5.52}Nb_{3.38}P_{16.67}B_{3.03}$ in accordance with embodiments of the present disclosure.

Sample metallic glass $Ni_{71.4}Cr_{5.52}Nb_{3.38}P_{16.67}B_{3.03}$ has a notch toughness of about 75 MPa $m^{1/2}$, which is about twice as that of the glass forming alloy having the largest critical rod diameter disclosed in the previous patent application Ser. No. 13/592,095. For example, the previous patent application discloses that the notch toughness of the alloy $Ni_{68.5}Cr_9Nb_3P_{16.5}B_3$, with a critical rod diameter of about 10 mm, is about 30 MPa $m^{1/2}$.

Various thermophysical, mechanical, and chemical properties of the metallic glass $Ni_{71.4}Cr_{5.52}Nb_{3.38}P_{16.67}B_{3.03}$ were investigated. Measured thermophysical properties include glass-transition, crystallization, solidus and liquidus temperatures, density, shear modulus, bulk modulus, and Young's modulus, and Poisson's ratio. Measured mechanical properties, in addition to notch toughness, include compressive yield strength, tensile yield strength, and hardness. Measured chemical properties include corrosion resistance in 6M HCl. These properties are listed in Table 2.

Figure 10:
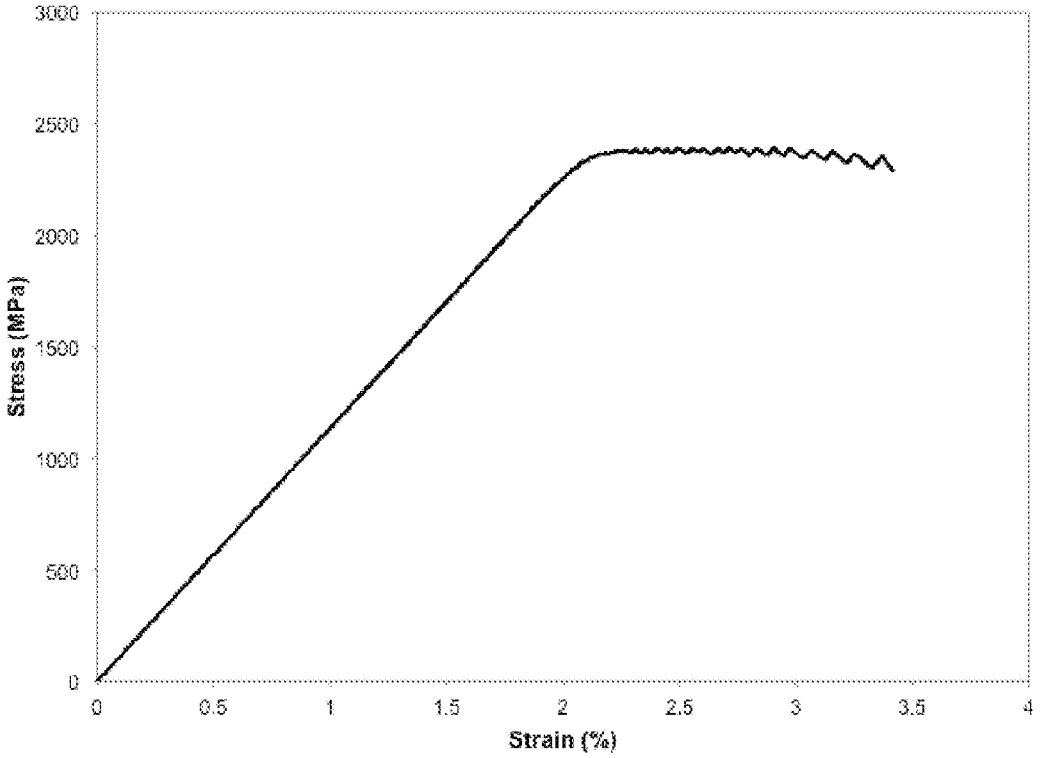
FIG. 10 provides a compressive stress-strain diagram for a sample metallic glass having composition $Ni_{71.4}Cr_{5.52}Nb_{3.38}P_{16.67}B_{3.03}$.
Figure 11:
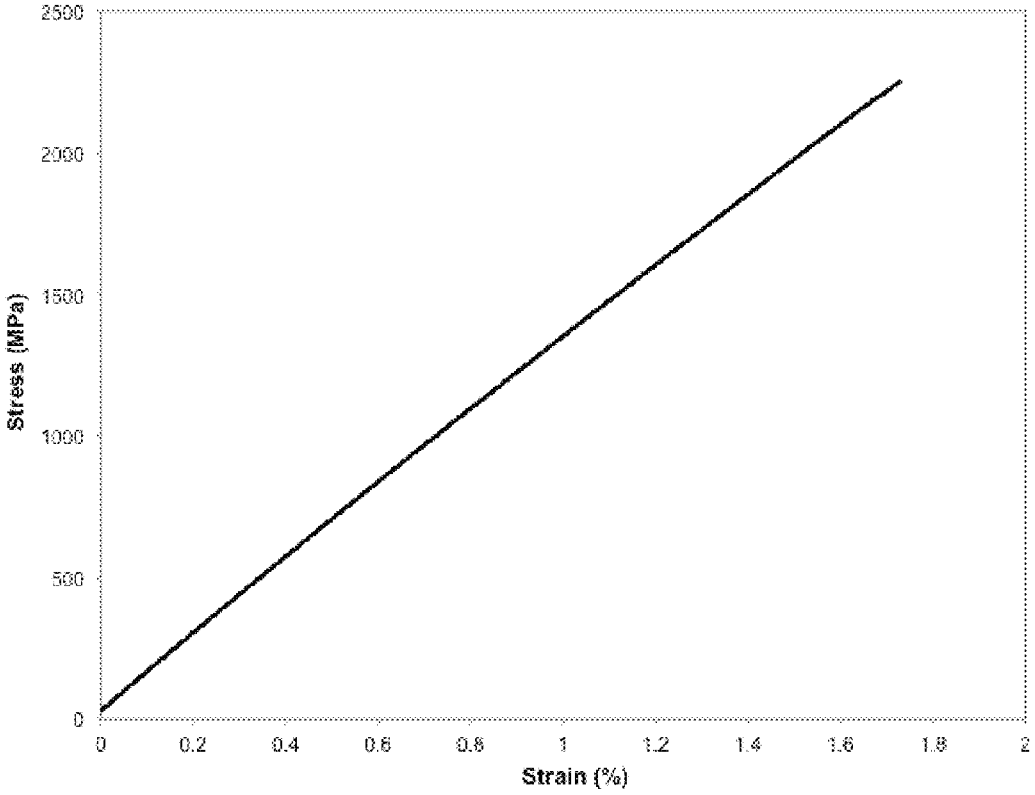
FIG. 11 provides a tensile stress-strain diagram for a sample metallic glass having composition $Ni_{71.4}Cr_{5.52}Nb_{3.38}P_{16.67}B_{3.03}$.
Figure 12:
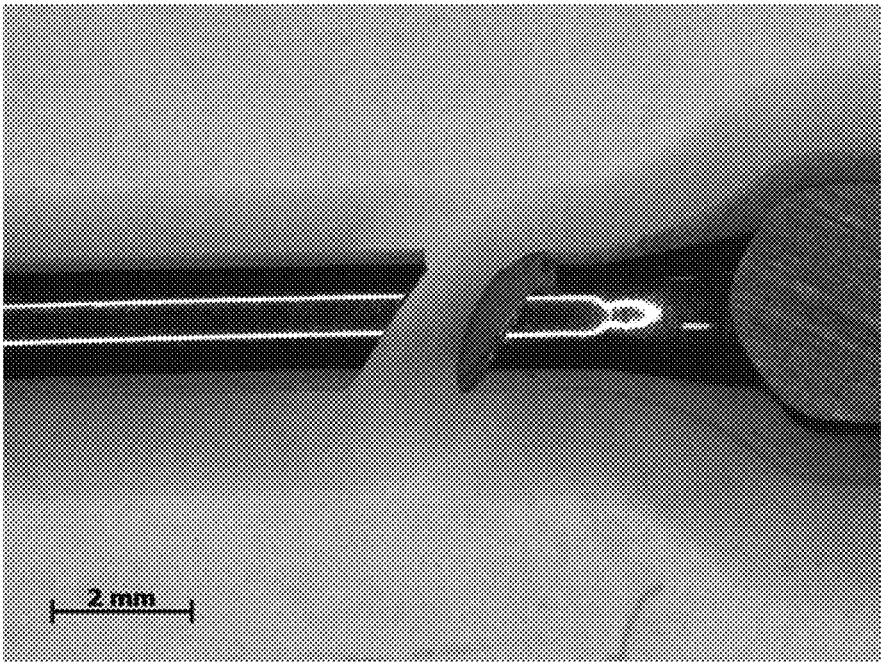
FIG. 12 provides an image of the fracture surface of a dog bone specimen of a sample metallic glass having composition $Ni_{71.4}Cr_{5.52}Nb_{3.38}P_{16.67}B_{3.03}$ failed in tension.

The yield strength, $\sigma_y$, which can be measured in compression as well as tension, is a measure of the material's ability to resist non-elastic yielding. The yield strength is the stress at which the material yields plastically. A high $\sigma_y$ ensures that the material will be strong. The compressive and tensile stress-strain diagrams for metallic glass $Ni_{71.4}Cr_{5.52}Nb_{3.38}P_{16.67}B_{3.03}$ are presented in FIGS. 10 and 11, respectively. The compressive and tensile yield strengths are estimated to be 2375 and 2250 MPa, respectively, and are listed in Table 2. It is interesting to note that the material shows considerable macroscopic plastic deformation in compression, as evidenced by the stress-strain diagram. While no macroscopic plastic deformation is evidenced in tension (which is not anticipated in metallic glasses), the material's failure is triggered by shear along a shear band, as evidenced by the fracture surface in FIG. 12, which is a characteristic of ductile metallic glasses.

Hardness is a measure of the material's ability to resist plastic indentation. A high hardness will ensure that the material will be resistant to indentation and scratching. The Vickers hardness of metallic glass $Ni_{71.4}Cr_{5.52}Nb_{3.38}P_{16.67}B_{3.03}$ is measured to be 720.7±9.1 kgf/$mm^2$. The hardness of all metallic glass compositions according to the current disclosure is expected to be over 700 kgf/$mm^2$.

A plastic zone radius, $r_p$, defined as $K_q^2/\pi\sigma_y^2$, where $\sigma_y$ is the tensile yield strength, is a measure of the critical flaw size at which catastrophic fracture is promoted. The plastic zone radius determines the sensitivity of the material to flaws; a high $r_p$ designates a low sensitivity of the material to flaws. The plastic zone radius of metallic glass $Ni_{71.4}Cr_{5.52}Nb_{3.38}P_{16.67}B_{3.03}$ is estimated to 0.35 mm.

Figure 13:
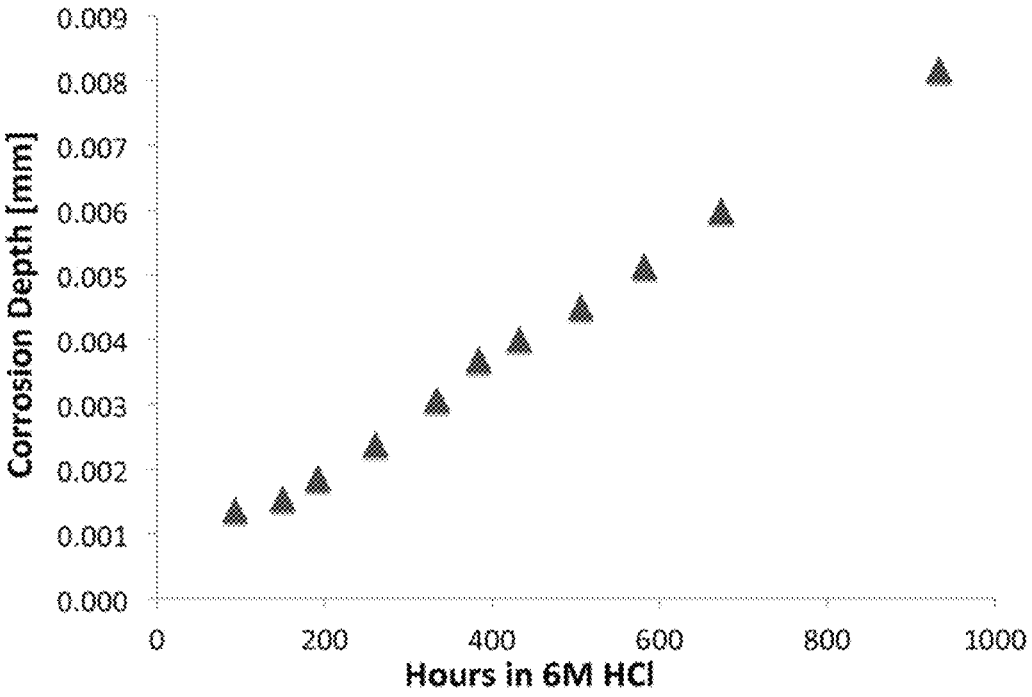
FIG. 13 provides a plot showing the corrosion depth versus time in a 6M HCl solution of a 3 mm metallic glass rod having composition $Ni_{71.4}Cr_{5.52}Nb_{3.38}P_{16.67}B_{3.03}$.

Lastly, the present Ni—Cr—Nb—P—B metallic glasses also exhibit an exceptional corrosion resistance. The corrosion resistance of example metallic glass $Ni_{71.4}Cr_{5.52}Nb_{3.38}P_{16.67}B_{3.03}$ is evaluated by immersion test in 6M HCl. The density of the metallic glass rod was measured using the Archimedes method to be 7.89 g/cc. A plot of the corrosion depth versus time is presented in FIG. 13. The corrosion depth at approximately 934 hours is measured to be about 8.2 micrometers. The corrosion rate is estimated to be 0.073 mm/year. The corrosion rate of all metallic glass compositions according to the current disclosure is expected to be under 1 mm/year.

TABLE 2

Thermophysical, Mechanical, and chemical properties for Sample metallic glass $Ni_{71.4}Cr_{5.52}Nb_{3.38}P_{16.67}B_{3.03}$.

| | |
|---|---|
| Composition | $Ni_{71.4}Cr_{5.52}Nb_{3.38}P_{16.67}B_{3.03}$ |
| Critical rod diameter | 11 mm |
| Glass-transition temperature | 393.0° C. |
| Crystallization temperature | 435.4° C. |
| Solidus temperature | 844.9° C. |
| Liquidus temperature | 889.6° C. |

TABLE 2-continued

Thermophysical, Mechanical, and chemical properties for Sample metallic glass $Ni_{71.4}Cr_{5.52}Nb_{3.38}P_{16.67}B_{3.03}$.

| | |
|---|---|
| Density | 7.89 g/cc |
| Yield strength (compressive) | 2375 MPa |
| Yield strength (tensile) | 2250 MPa |
| Hardness | 720.7 ± 9.1 $kgf/mm^2$ |
| Notch toughness | 74.6 MPa $m^{1/2}$ |
| Plastic zone radius | 0.35 mm |
| Shear modulus | 48.9 GPa |
| Bulk modulus | 178.1 GPa |
| Young's modulus | 134.4 GPa |
| Poisson's ratio | 0.3744 |
| Corrosion rate (6M HCl) | 73.3 μm/year |

Description of Methods of Processing the Sample Alloys

A method for producing the alloys involves inductive melting of the appropriate amounts of elemental constituents in a quartz tube under inert atmosphere. The purity levels of the constituent elements were as follows: Ni 99.995%, Cr 99.996%, Nb 99.95%, P 99.9999%, Si 99.9999%, and B 99.5%. The melting crucible may alternatively be a ceramic such as alumina or zirconia, graphite, sintered crystalline silica, or a water-cooled hearth made of copper or silver.

A particular method for producing metallic glass rods from the alloy ingots involves re-melting the alloy ingots in quartz tubes having 0.5-mm thick walls in a furnace at 1100° C. or higher, and in some embodiments, ranging from 1150° C. to 1400° C., under high purity argon and rapidly quenching in a room-temperature water bath. Alternatively, the bath could be ice water or oil. Metallic glass articles can be alternatively formed by injecting or pouring the molten alloy into a metal mold. The mold can be made of copper, brass, or steel, among other materials.

Fused silica is generally a poor thermal conductor. Increasing the thickness of the tube wall slows the heat removal rate during the melt quenching process, thereby limiting the diameter of a rod that can be formed with an amorphous phase by a given composition. For example, the alloy $Ni_{71.4}Cr_{5.52}Nb_{3.38}P_{16.67}B_{3.03}$ is capable of forming a 11 mm diameter rod (Sample 5 in Table 1) when processed by water quenching the high temperature melt in a fused silica tube having wall thickness of 0.5 mm. When processed in the same manner in a fused silica tube having wall thickness of 1.0 mm, the alloy $Ni_{71.4}Cr_{5.52}Nb_{3.38}P_{16.67}B_{3.03}$ is capable of forming metallic glass rods of 10 mm in diameter.

Optionally, prior to producing an amorphous article, the alloyed ingots may be fluxed with a reducing agent by re-melting the ingots in a quartz tube under inert atmosphere, bringing the alloy melt in contact with the molten reducing agent, and allowing the two melts to interact for about 1000 s at a temperature of about 1200° C. or higher, under inert atmosphere and subsequently water quenching.

Test Methodology for Assessing Glass-Forming Ability

The glass-forming ability of each alloy was assessed by determining the maximum rod diameter in which the amorphous phase of the alloy (i.e. the metallic glass phase) could be formed when processed by the method described above. X-ray diffraction with Cu—Kα radiation was performed to verify the amorphous structure of the alloys.

Test Methodology for Differential Scanning Calorimetry

Differential scanning calorimetry was performed on sample metallic glasses at a scan rate of 20 K/min to determine the glass-transition, crystallization, solidus, and liquidus temperatures of sample metallic glasses.

Test Methodology for Measuring Notch Toughness

The notch toughness of sample metallic glasses was performed on 3-mm diameter rods. The rods were notched using a wire saw with a root radius ranging from 0.10 to 0.13 mm to a depth of approximately half the rod diameter. The notched specimens were tested on a 3-point beam configuration with span of 12.7 mm, and with the notched side carefully aligned and facing the opposite side of the center loading point. The critical fracture load was measured by applying a monotonically increasing load at constant cross-head speed of 0.001 mm/s using a screw-driven testing frame. At least three tests were performed, and the variance between tests is included in the notch toughness plots. The stress intensity factor for the geometrical configuration employed here was evaluated using the analysis by Murakimi (Y. Murakami, Stress Intensity Factors Handbook, Vol. 2, Oxford: Pergamon Press, p. 666 (1987)).

Test Methodology for Measuring Compressive Yield Strength

Compression testing of sample metallic glasses was performed on cylindrical specimens 3 mm in diameter and 6 mm in length. A monotonically increasing load was applied at a constant cross-head speed of 0.001 mm/s using a screw-driven testing frame. The strain was measured using a linear variable differential transformer. The compressive yield strength was estimated using the 0.2% proof stress criterion.

Test Methodology for Measuring Tensile Yield Strength

Uniaxial tensile testing was performed according to ASTM E8 (Standard Test Methods for Tension Testing of Metallic Materials). A tensile dog bone sample was prepared with a reduced 14 mm-long gauge length and a 2 mm diameter circular gauge cross section. The sample was pulled at a crosshead speed of 1 μm/s on a screw-driven testing frame. The strain was measured with an extensometer located within the reduced gauge section.

Test Methodology for Measuring Hardness

The Vickers hardness (HV0.5) of sample metallic glasses was measured using a Vickers microhardness tester. Seven tests were performed where micro-indentions were inserted on a flat and polished cross section of a 3 mm metallic glass rod using a load of 500 g and a duel time of 10 s.

Test Methodology for Measuring Density and Moduli

The shear and longitudinal wave speeds of were measured ultrasonically on a cylindrical metallic glass specimen 3 mm in diameter and about 3 mm in length using a pulse-echo overlap set-up with 25 MHz piezoelectric transducers. The density was measured by the Archimedes method, as given in the American Society for Testing and Materials standard C693-93. Using the density and elastic constant values, the shear modulus, bulk modulus, Young's modulus and Poisson's ratio were estimated.

Test Methodology for Measuring Corrosion Resistance

The corrosion resistance of sample metallic glasses was evaluated by immersion tests in hydrochloric acid (HCl). A rod of metallic glass sample with initial diameter of 2.90 mm, and a length of 19.41 mm was immersed in a bath of 6M HCl at room temperature. The density of the metallic glass rod was measured using the Archimedes method. The corrosion depth at various stages during the immersion was estimated by measuring the mass change with an accuracy of ±0.01 mg. The corrosion rate was estimated assuming linear kinetics.

The disclosed Ni—Cr—Nb—P—B or Ni—Cr—Nb—P—B—Si alloys with controlled ranges along the composition ridge demonstrate good glass forming ability. The disclosed alloys are capable of forming metallic glass rods of diameters at least 6 mm and up to about 11 mm or greater when processed by the particular method described herein. Certain alloys with very good glass forming ability also have relatively high toughness exceeding 70 MPa $m^{1/2}$. The combination of high glass-forming ability along with excellent mechanical and corrosion performance makes the present Ni-based metallic glasses excellent candidates for various engineering applications. Among many other applications, the disclosed alloys may be used in consumer electronics, dental and medical implants and instruments, luxury goods, and sporting goods applications.

Having described several embodiments, it will be recognized by those skilled in the art that various modifications, alternative constructions, and equivalents may be used without departing from the spirit of the invention. Additionally, a number of well-known processes and elements have not been described in order to avoid unnecessarily obscuring the present invention. Accordingly, the above description should not be taken as limiting the scope of the invention.

Those skilled in the art will appreciate that the presently disclosed embodiments teach by way of example and not by limitation. Therefore, the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall therebetween.

What is claimed is:

1. An alloy capable of forming a metallic glass, the alloy comprising:

$$Ni_{(100-a-b-c-d)}Cr_aNb_bP_cB_d$$

wherein an atomic percent of chromium (Cr) a ranges from 4 to 9, an atomic percent of niobium (Nb) b is determined by x-y*a, wherein x ranges from 3.8 to 4.2 and y ranges from 0.11 to 0.14, an atomic percent of phosphorus (P) c ranges from 16.25 to 17, an atomic percent of boron (B) d ranges from 2.75 to 3.5, and the balance is nickel (Ni), and wherein the alloy has a critical rod diameter of at least 9 mm, wherein the metallic glass has a stress intensity factor at crack initiation when measured on a 3 mm diameter rod containing a notch with length between 1 and 2 mm and root radius between 0.1 and 0.15 mm, the stress intensity factor being at least 70 MPa $m^{1/2}$.

2. The alloy of claim 1, wherein the alloy comprises $Ni_{77.4375-0.875a}Cr_aNb_{4.0625-0.125a}P_{16.5}B_3$, and the atomic percent of Cr a is from 4 to 9.

3. The alloy of claim 1, wherein up to 1 atomic percent of P is substituted by silicon (Si).

4. The alloy of claim 1, wherein up to 2 atomic percent of Cr is substituted by Fe, Co, Mn, W, Mo, Ru, Re, Cu, Pd, Pt, or combinations thereof.

5. The alloy of claim 1, wherein up to 2 atomic percent of Ni is substituted by Fe, Co, Mn, W, Mo, Ru, Re, Cu, Pd, Pt, or combinations thereof.

6. The alloy of claim 1, wherein up to 1.5 atomic % of Nb is substituted by Ta, V, or combinations thereof.

7. The alloy of claim 1, wherein the alloy comprises composition $Ni_{71.4}Cr_{5.52}Nb_{3.38}P_{16.67}B_{3.03}$ that has a critical rod diameter of at least 10 mm.

8. A metallic glass comprising the alloy of claim 1.

9. A method for processing an alloy to form a metallic glass, the method comprising:

melting an alloy comprising at least Ni, Cr, Nb, P, and B with a formula $Ni_{(100-a-b-c-d)}Cr_aNb_bP_cB_d$ wherein an atomic percent of chromium (Cr) a ranges from 4 to 9, an atomic percent of niobium (Nb) b is determined by x-y*a, wherein x ranges from 3.8 to 4.2 and y ranges from 0.11 to 0.14, an atomic percent of phosphorus (P) c ranges from 16.25 to 17, an atomic percent of boron (B) d ranges from 2.75 to 3.5, and the balance is nickel (Ni), wherein the alloy has a critical rod diameter of at least 9 mm, into a molten state; and quenching the molten alloy at a cooling rate sufficiently rapid to prevent crystallization of the alloy to form the metallic glass, wherein the metallic glass has a stress intensity factor at crack initiation when measured on a 3 mm diameter rod containing a notch with length ranging from 1 to 2 mm and root radius ranging from 0.1 to 0.15 mm, the stress intensity factor being at least 70 MPa $m^{1/2}$.

10. The method of claim 9, further comprising fluxing the molten alloy prior to quenching by using a reducing agent.

11. The method of claim 9, the step of melting the alloy comprising melting the alloy at a temperature of at least 100° C. above the liquidus temperature of the alloy.

12. The method of claim 9, the step of melting the alloy comprising melting the alloy at a temperature of at least 1100° C.

13. The method of claim 9, wherein the alloy is selected from a group consisting of compositions $Ni_{72.5}Cr_{4.5}Nb_{3.5}P_{16.5}B_3$, $Ni_{71.4}Cr_{5.52}Nb_{3.38}P_{16.17}B_{3.03}Si_{0.5}$, and $Ni_{70.5}Cr_{6.78}Nb_{3.22}P_{16.5}B_3$.

14. The method of claim 13, wherein the alloy comprises $Ni_{71.4}Cr_{5.52}Nb_{3.38}P_{16.67}B_{3.03}$ and has a critical rod diameter of at least 10 mm.

* * * * *